United States Patent [19]

Prindle

[11] 4,317,284

[45] Mar. 2, 1982

[54] FLATWARE EATING UTENSILS

[76] Inventor: William A. Prindle, 651½ Maple Ave., New Martinsville, W. Va. 26155

[21] Appl. No.: 132,709

[22] Filed: Mar. 21, 1980

[51] Int. Cl.[3] ..... A47G 21/06; B26B 3/02

[52] U.S. Cl. ..... 30/340; 30/147; 7/901

[58] Field of Search ..... 7/901; 269/8; 30/142, 30/147, 148, 149, 150; 24/73 MS, 201 B; 30/343, 340

[56] References Cited

U.S. PATENT DOCUMENTS

| | | | |
|---|---|---|---|
| D. 81,977 | 9/1930 | Hansen | 30/340 |
| 308,753 | 12/1884 | Cox | 30/340 |
| 2,277,777 | 3/1942 | Ponto | 30/149 X |
| 2,565,624 | 8/1951 | Phelon | 7/901 |
| 2,975,497 | 3/1961 | Budreck | 24/201 B |
| 3,034,320 | 5/1962 | Feibelman | 24/201 B |
| 3,290,720 | 12/1966 | Gordon | 30/149 X |
| 4,178,684 | 12/1979 | Mighty | 30/340 |

FOREIGN PATENT DOCUMENTS

| | | | |
|---|---|---|---|
| 152121 | 10/1920 | United Kingdom | 30/148 |
| 807255 | 1/1959 | United Kingdom | 30/148 |

*Primary Examiner*—Jimmy C. Peters

*Attorney, Agent, or Firm*—Beveridge, DeGrandi & Kline

[57] ABSTRACT

A knife, fork and spoon are held together magnetically. The outside edges of the fork tines correspond to the curvature of the spoon bowl, and the tines are curved to correspond to the interior of the spoon bowl. The major faces of the knife blade are perpendicular to the major faces of the knife handle, and the knife blade extends between the fork tines toward the longitudinal centerline of the spoon bowl. The tip of the knife blade lies near the forwardmost edge of the spoon bowl, and the cutting edge of the knife blade has a curvature corresponding to that of the centerline of the spoon bowl.

11 Claims, 5 Drawing Figures

FLATWARE EATING UTENSILS

BACKGROUND OF THE INVENTION

This invention relates to eating utensils and is concerned with a knife of unique construction, a set of eating utensils which fit together in a novel manner, and a set of eating utensils which are held together magnetically.

The prior art is replete with sets of flatware eating utensils which include a knife, fork and spoon or various combinations of two such utensils. Representative descriptions of such sets are found in the patents presently classified by the U.S. Patent and Trademark Office in Class 30, subclass 147. Commonly, these sets have a spoon, a fork which overlies and is nested with respect to the spoon and a knife which overlies the fork and has a flat blade coplanar with its flat handle. Clips, bands or other mechanical connections are commonly used to hold these sets together when in a nonuse or storage condition.

SUMMARY OF THE INVENTION

In one respect, this invention pertains to a knife structure in which a flat blade and flat handle are longitudinally aligned with each other but are perpendicular so that the handle is generally horizontal when the knife is in a vertical cutting orientation. Specifically, a flat handle and a flat blade with a lower cutting edge both extend generally longitudinally, and the blade lies perpendicular to the generally flat handle. This allows a user to apply a greater cutting force, and it facilitates manipulation of the knife during use. Preferably, a forward portion of the handle overlies and is connected to the blade and, concomitantly, at least a rear portion of the blade underlies and is connected to the handle.

In another respect, the invention involves an eating utensil set which includes at least a spoon and a knife. The handle of the knife is disposed substantially parallel to and above the handle of the spoon. The knife blade has a cutting edge which is directed toward the longitudinal centerline of the spoon bowl and may have a curvature which corresponds to the curvature of the spoon bowl. The tip of the blade, formed at the intersection of the cutting edge and the upper edge of the blade, is located substantially at the forward end of the spoon bowl. If the set includes a fork positioned between the spoon and knife, the knife blade extends between two tines of the fork. The tines are curved to conform substantially to the interior of the spoon bowl, and their outside edges correspond to the curvature of the edge of the spoon bowl.

In another sense, the invention pertains to a set of eating utensils, the handles of which are held together by magnetic means.

Although the invention may take many forms, the accompanying drawings and the following text describe a preferred embodiment thereof.

DESCRIPTION OF A PREFERRED EMBODIMENT

Figure 1:
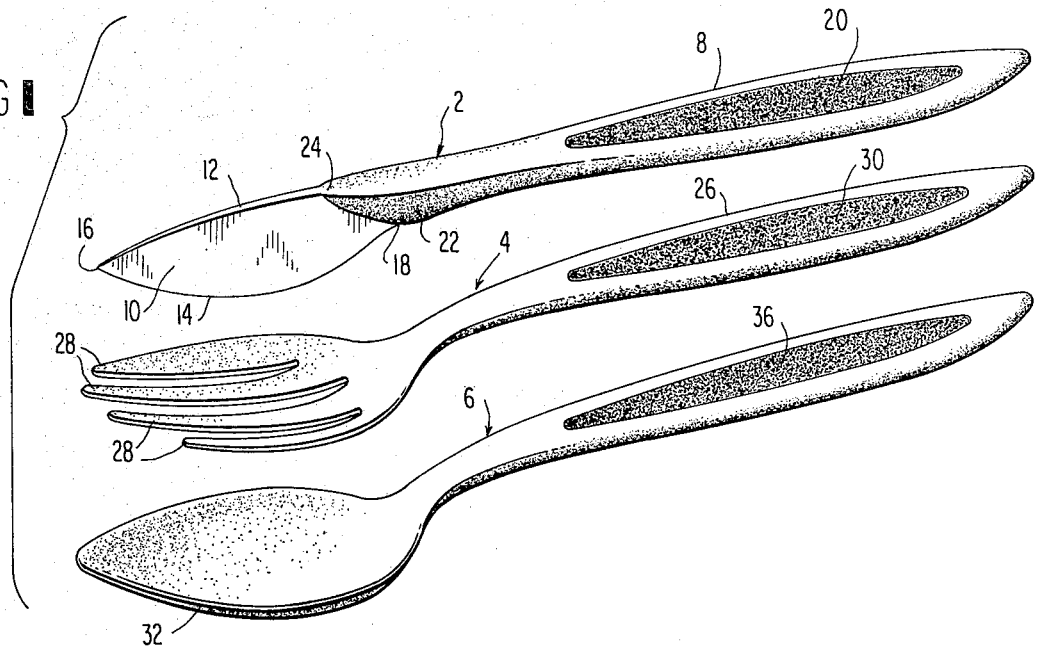
FIG. 1 is an exploded perspective view of a set of eating utensils constructed according to the invention.

FIG. 1 shows a set of utensils including a knife 2, a fork 4 and a spoon 6. The knife 2 has a flat handle 8 with a forward end which overlies and is connected to a blade 10. The handle 8 and blade 10 both extend longitudinally of the knife but, unlike conventional knives, the flat blade 10 is perpendicular to the flat handle 8 so that, in normal use, the blade is vertical and the handle is horizontal. The blade 10 has an upper edge 12 and a convexly curved lower cutting edge 14 which intersect at the blade tip 16. The cutting edge 14 extends rearwardly to a point 18 located beneath the handle 8 and it is sharpened, serrated or otherwise configured to enable it to cut the food being consumed.

Figure 2:
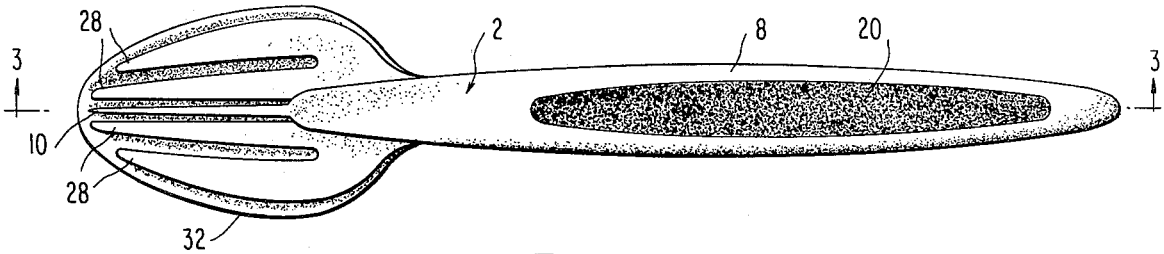
FIG. 2 is a plan view of the utensils of FIG. 1 when nested together for storage.
Figure 3:
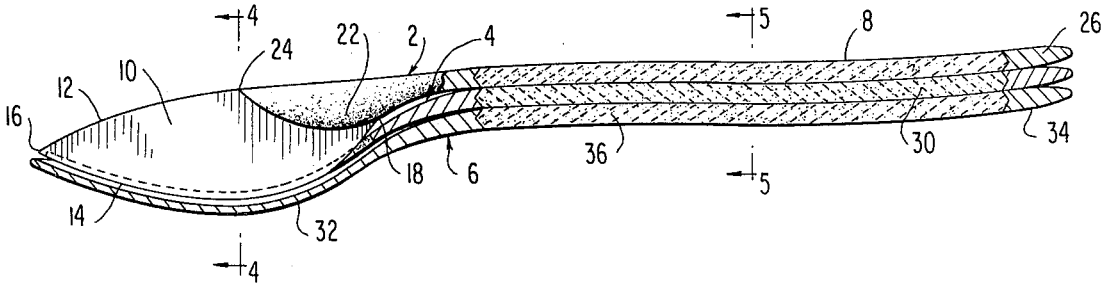
FIG. 3 is a partially sectioned elevational view of the utensil set shown in FIG. 1 when nested together for storage.
Figure 4:
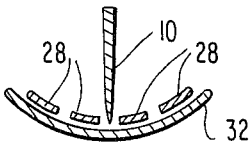
FIGS. 4 and 5 are transverse sectional views of the nested set of utensils as seen along the lines 4—4 and 5—5 in FIG. 3.
Figure 5:
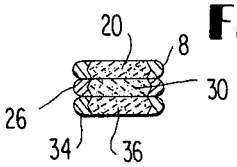

The knife handle 8 has an inset permanent magnet 20 which attracts similar pieces in the handles of the fork 4 and spoon 6 when the set is nested together as shown in FIGS. 2–5. The forward portion of the knife handle 8 has a generally convex lower surface 22, the lowest point of which coincides with the rear end 18 of the cutting edge 14. As seen in FIG. 3, the lower surface of the handle and the cutting edge of the blade form a continuous uninterrupted curve extending through the point 18. Progressing forwardly from point 18, the thickness of the handle 8 decreases up to its forward end 24.

The fork 4 has a flat handle 26 and an upwardly concave forward portion with three longitudinal slits which form four tines 28. The fork handle 26 contains an inset permanent magnet 30. The spoon 6 has a forward bowl portion 32 and a flat handle 34 which includes an inset permanent magnet 36. One suitable material for the magnetic pieces 20, 30 and 36 is an elastomeric magnetic sheet material which is available from Permag Corporation, Shrewsbury, Mass.

The utensils 2, 4, and 6 are held together in parallel stacked relation when not in use by the magnetic attraction between the pieces 20, 30 and 36 in their handles. The magnets have polarities which cause the handles to assume a parallel alignment with each other.

Referring to FIGS. 2 and 3, it will be observed that the utensils, when stacked together, form a very neat, simple, compact and efficient unit. The convex curvature of the fork tines 28 conforms substantially to the concave interior of the spoon bowl 32 and the outside edges of the fork tines 28 correspond to the curvature of the edge of the spoon bowl 32. The knife blade 10 extends between two of the tines and toward the longitudinal centerline of the spoon bowl 32. The tip 16 of the knife blade 10 is located substantially at the forward edge of the spoon bowl 32, and the cutting edge 14 of the knife blade substantially corresponds to the curvature of the spoon bowl 32. Apart from its simplicity and efficiency, this arrangement also introduces an element of safety as there are no projecting sharp edges, and the cutting edge of the knife of the knife blade is shielded by the spoon bowl.

Persons familiar with the field of the invention will appreciate that it may take many forms other than the specific embodiment shown. For example, the interfitting relationship may be used with a different means for holding the utensils together. The knife may, rather than having the handle overlying the blade, have the handle connected to the blade by a helically twisted section. The fork may be omitted from the eating utensil set, or the knife may be used apart from the set shown. In fact, the knife itself needn't be an eating utensil as its blade/handle relationship is useful in connection with surgical scalpels and other cutting implements. Magnetic retaining means may be separate from the utensils or they may be used for holding together eating utensil sets which are otherwise of conventional prior art construction. The utensils may be made of a variety of materials including pewter, stainless steel, sterling silver or appropriate organic synthetic polymer plastics, the latter being particularly suitable for production of low cost disposable or reusable utensil sets.

In view of the many forms which the invention may take, it is emphasized that the invention is not limited solely to the disclosed embodiment but is embracing of modifications thereto and improvements thereof which fall within the spirit of the following claims.

I claim:

1. A knife, comprising a generally flat longitudinally extending blade and a generally flat longitudinally extending handle, said blade being substantially vertical and being centrally positioned with respect to the longitudinal centerline of the handle, said handle being substantially horizontal and having a width which is substantially greater than its thickness, said blade lying perpendicular to the generally flat handle and being provided with a lower cutting edge, said handle having a forward portion which overlies and is connected to the blade, said blade having at least a rear portion which underlies and is connected to the handle.

2. An eating utensil set which includes a spoon and a knife, said spoon being provided with a handle and a bowl, said knife being provided with a handle and a blade, said handles lying in substantially parallel relation to each other with the handle of the knife being disposed above the handle of the spoon, said knife having a blade which is centrally positioned with respect to the longitudinal centerline of the knife handle, said blade having a cutting edge which is directed toward the longitudinal centerline of the spoon bowl.

3. An eating utensil set according to claim 2 including means for holding the handles together in parallel stacked relation.

4. An eating utensil set according to claim 2 or claim 3 wherein the knife blade extends longitudinally and is generally flat, said knife handle extends longitudinally and is generally flat with its width being substantially greater than its thickness, said knife blade lying perpendicular to the generally flat knife handle.

5. An eating utensil set according to claim 2 or claim 3 wherein the cutting edge of the knife blade has a curvature which corresponds to the curvature of the bowl of the spoon.

6. An eating utensil set according to claim 2 or claim 3 wherein the knife blade has an upper edge which intersects said cutting edge at an apex, said apex being located substantially at the forward edge of the spoon bowl.

7. An eating utensil set according to claim 2 or claim 3 which also includes a fork which is provided with a handle and a plurality of tines, said tines being positioned in the bowl of the spoon, said blade of the knife extending between two of the tines.

8. An eating utensil set according to claim 7 wherein the tines are curved to conform substantially to the interior of the bowl of the spoon.

9. An eating utensil set according to claim 7 wherein the tines have outside edges which correspond to the curvature of the edge of the bowl of the spoon.

10. An eating utensil set which includes a spoon and a knife, said spoon being provided with a handle and a bowl, said knife being provided with a handle and a blade, said handles lying in substantially parallel relation to each other with the handle of the knife being disposed above the handle of the spoon, said knife having a blade with a cutting edge which is directed toward the longitudinal centerline of the spoon bowl, and magnetic means for holding said handles together in parallel stacked relation.

11. An eating utensil set according to claim 10 which also includes a fork which is provided with a handle and a plurality of tines, said tines being positioned in the bowl of the spoon, said blade of the knife extending between two of the tines.

* * * * *